US006543195B2

(12) United States Patent
Rahimzadeh

(10) Patent No.: US 6,543,195 B2
(45) Date of Patent: Apr. 8, 2003

(54) COMPOSITE STRUCTURAL FRAMING SYSTEM

(75) Inventor: Housh Rahimzadeh, Alpharetta, GA (US)

(73) Assignee: Diversakore LLC, Atlanta, GA (US)

( * ) Notice: Subject to any disclaimer, the term of this patent is extended or adjusted under 35 U.S.C. 154(b) by 0 days.

(21) Appl. No.: 10/012,974

(22) Filed: Dec. 7, 2001

(65) Prior Publication Data

US 2002/0069598 A1 Jun. 13, 2002

Related U.S. Application Data

(60) Provisional application No. 60/254,278, filed on Dec. 8, 2000.

(51) Int. Cl.[7] ..... E04C 3/00; E04C 3/30; E04B 1/20

(52) U.S. Cl. ..... 52/320; 52/323; 52/325; 52/326; 52/327; 52/334; 52/335

(58) Field of Search ..... 52/320, 323, 325, 52/326, 327, 334, 335

(56) References Cited

U.S. PATENT DOCUMENTS

| | | | | |
|---|---|---|---|---|
| 1,220,915 | A | * | 3/1917 | Wells |
| 1,867,615 | A | * | 7/1932 | Davis |
| 4,037,375 | A | * | 7/1977 | Maggos |
| 4,211,045 | A | | 7/1980 | Koizumi et al. |
| 4,443,985 | A | | 4/1984 | Moreno |
| 4,741,138 | A | * | 5/1988 | Rongoe |
| 4,903,448 | A | | 2/1990 | Compton |
| 4,951,438 | A | | 8/1990 | Thoresen |
| 5,050,358 | A | * | 9/1991 | Vladislavic |
| 5,174,080 | A | | 12/1992 | Yoshimura et al. |
| 5,253,460 | A | | 10/1993 | Simenoff |
| 5,566,520 | A | | 10/1996 | Branitzky |
| 5,682,717 | A | | 11/1997 | Carranza-Aubry |
| 5,704,181 | A | | 1/1998 | Fisher et al. |
| 5,978,997 | A | * | 11/1999 | Grossman |

FOREIGN PATENT DOCUMENTS

| | | | |
|---|---|---|---|
| DE | 31 16 102 A1 | | 11/1982 |
| EP | 0 345 620 | | 5/1989 |
| FR | 1295131 | * | 4/1962 |
| WO | WO 92/08018 | | 5/1992 |

* cited by examiner

*Primary Examiner*—Carl D. Friedman
*Assistant Examiner*—Kevin McDermott
(74) *Attorney, Agent, or Firm*—Paul Knowlton; Cynthia R. Parks; Kilpatrick Stockton LLP

(57) ABSTRACT

The structural framing system comprises a steel beam that supports flooring components interconnected through the addition of a solidifying material such as poured concrete. A structural framing system is created by anchoring steel beams to vertical columns, spanning floor sections between the steel beams, pouring concrete into the interior of the beams and contacting the flooring components, and then forming a rigid joint between the steel beam, floor sections and columns through the addition of a bonding layer.

12 Claims, 4 Drawing Sheets

COMPOSITE STRUCTURAL FRAMING SYSTEM

RELATED APPLICATION

The present application claims priority to U.S. Provisional Application Ser. No. 60/254,278 entitled "Composite Structural Framing System" filed on Dec. 8, 2000.

FIELD OF THE INVENTION

The present invention relates to building construction and more specifically to a composite steel and concrete framing system that forms a substantially monolithic support structure.

BACKGROUND OF THE INVENTION

In the field of building construction, specifically the erection of multi-story buildings, the framing system constitutes the essential load-bearing structure that provides the stability and structural integrity of the building. The typical multi-story framing system consists of a plurality of stacked vertical columns interconnected with horizontal support beams. Typically, vertical columns and horizontal beams are composed of either steel, precast concrete, or formed-in-place concrete. Further, the horizontal beams typically support flooring sections of precast concrete, metal, or formed-in-place concrete. The framing system is designed to support well in excess of the anticipated loads developed by the structure itself and all live loads placed thereon. The forces generated by these loads are largely borne by the horizontal beams, the vertical columns and the connection members that join the beams and columns.

One known method of erecting a framing system is to pour concrete in place, utilizing suitable forms, to produce vertical columns, horizontal beams and floor sections. Pouring concrete in place has the advantage of producing buildings which are strong, highly rigid, durable and highly fire resistant. However, this method requires the use of labor intensive forms and complicated temporary supports which are expensive, easily destroyed and impede efficient work flow.

Another known method of erecting a framing system is to assemble precast concrete columns, beams and floor sections. This method has the advantage of rapid erection, with little need for temporary supports. However, precast concrete buildings tend to be less rigid than poured-in-place concrete buildings and have other inherent structural limitations. Still another often practiced method of erecting a framing system is to assemble steel columns and beams with steel or concrete floor sections. This method also has the advantage of rapid erection when steel precast concrete floor sections are used. Similar to the framing system assembled of precast concrete, steel buildings have inherent structural limitations. Most notably, these known framing systems are limited by the forces borne by the connecting members—typically the weakest elements of the framing system.

Presently, no framing system provides a support structure which is both highly rigid and fire resistant as found with a poured-in-place system while easy to assemble as found with a steel system. Thus, there exists a need for a highly rigid and fire resistant framing structure which may be erected without temporary forms and complicated supports while overcoming the limitations found in connecting members.

SUMMARY OF THE INVENTION

The present invention addresses the shortcomings described above by providing a system of horizontal composite beams supported by vertical columns, which support flooring components such as precast planks or metal deck sections that receive poured concrete. A pourable bonding layer, such as a plasticized or cementitious material that hardens, tops the flooring components and bonds the flooring components, composite beams and columns. Each composite beam comprises a steel beam and interior of plasticized or solidifying material such as poured concrete. In the preferred embodiment, the steel beam includes a bottom plate, adjacent containment sides fortified by strap bars, studs, and horizontal support members. The horizontal support members provide a support surface for the floor components. Alternatively, the individual elements of the steel beam may be formed as a single, substantially monolithic unit. Reinforcing members such as rebar and post tensioned cables provide additional force bearing capacity to the composite beam.

In erecting the preferred framing system, concrete vertical columns are provided, each with at least one receiving saddle for supporting the end of a steel beam. The steel beams are raised and the flooring components, which span between adjacent steel beams, are set. Concrete is then poured to fill the interior of the steel beam; the strap bars act to resist the outward forces created by the wet concrete and the studs act to bond the cured concrete to the steel beam. Sufficient concrete is poured to fill the steel beam, flow into the hollow cores of precast floor planks, and rise to the upper surface of the planks. Alternatively, concrete is poured to fill the steel beam and added to fill a deck component to create a subfloor. Concrete can continue to be added to form a bonding layer and to fill all voids in or around the columns, thereby creating a substantially monolithic layer. Some blocking may be necessary at the columns to stop seepage of the concrete or bonding layer while the concrete is wet.

In a preferred embodiment, the composite beam is adapted for use along the perimeter of a horizontal level.

BRIEF DESCRIPTION OF DRAWINGS

The accompanying drawings, which are incorporated in and form a part of the specification, illustrate preferred embodiments of the present invention and, together with the description, disclose the principles of the invention. In the drawings.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Figure 1:
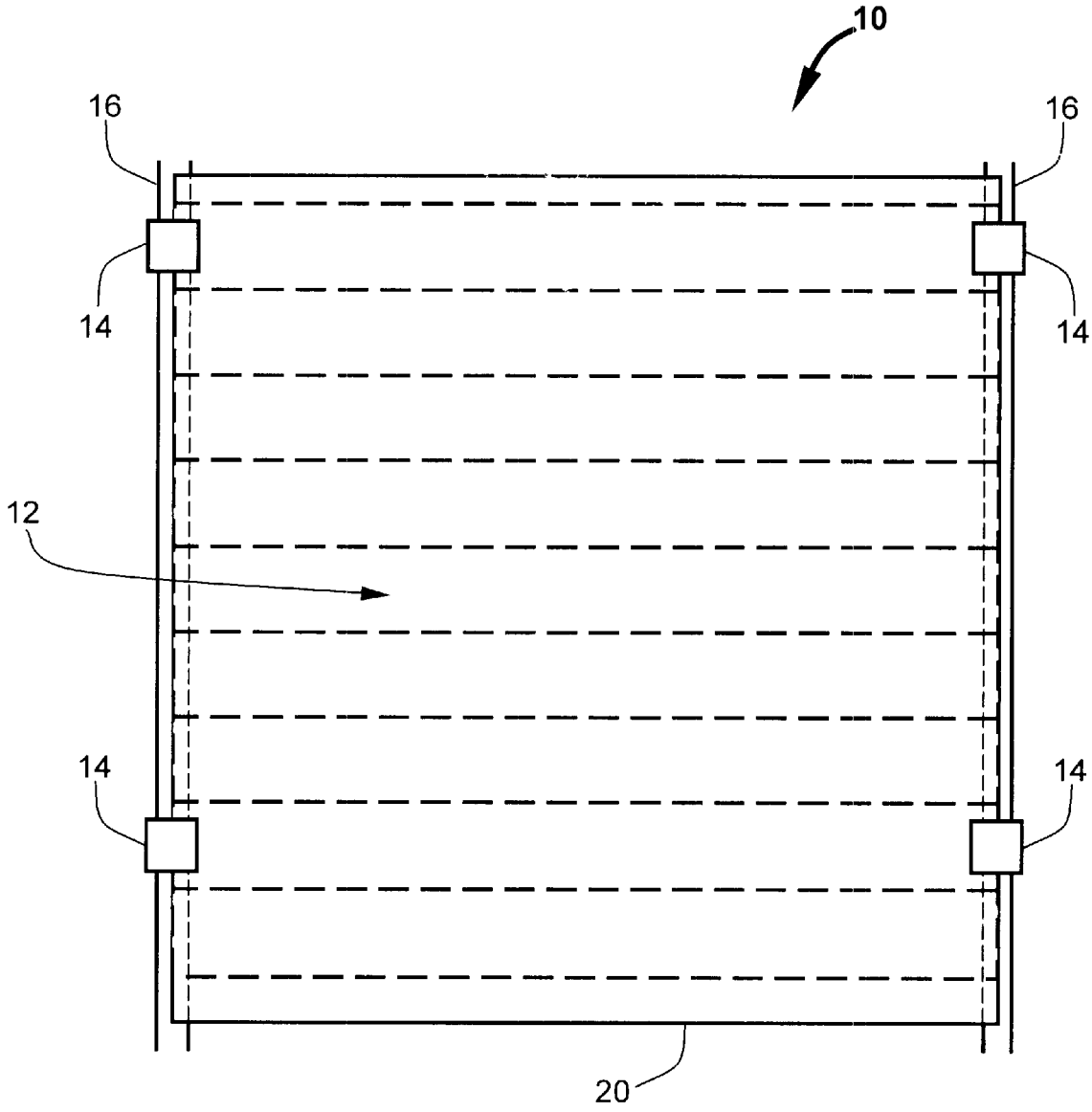
FIG. 1 is a top view illustrating a typical section of the flooring system of a preferred embodiment, including precast floor sections.

Referring to the drawings wherein like elements are designated by like numbers, FIG. 1 illustrates a top view of the composite structural framing system 10. Generally speaking,,the system 10 consists of flooring components 12 that are supported by vertical columns 14 and horizontal composite beams 16. Vertical columns 14 are located as necessary to support the composite beams 16. Each vertical column 14 is typically connected to and supports at least one composite beam 16. The composite beams 16 support floor components 12 which may be, by way of illustration and not limitation, precast hollow core planks or metal deck sections which receive poured concrete. As explained in detail below, a pourable bonding layer 20 tops the flooring components 12 to join the flooring components, the composite beams 16, and columns 14 to create a rigid joint. By way of example and not limitation, the bonding layer 20 is a plasticized material, such as concrete, that hardens to provide improved structural integrity between the discrete framing components.

Figure 2:
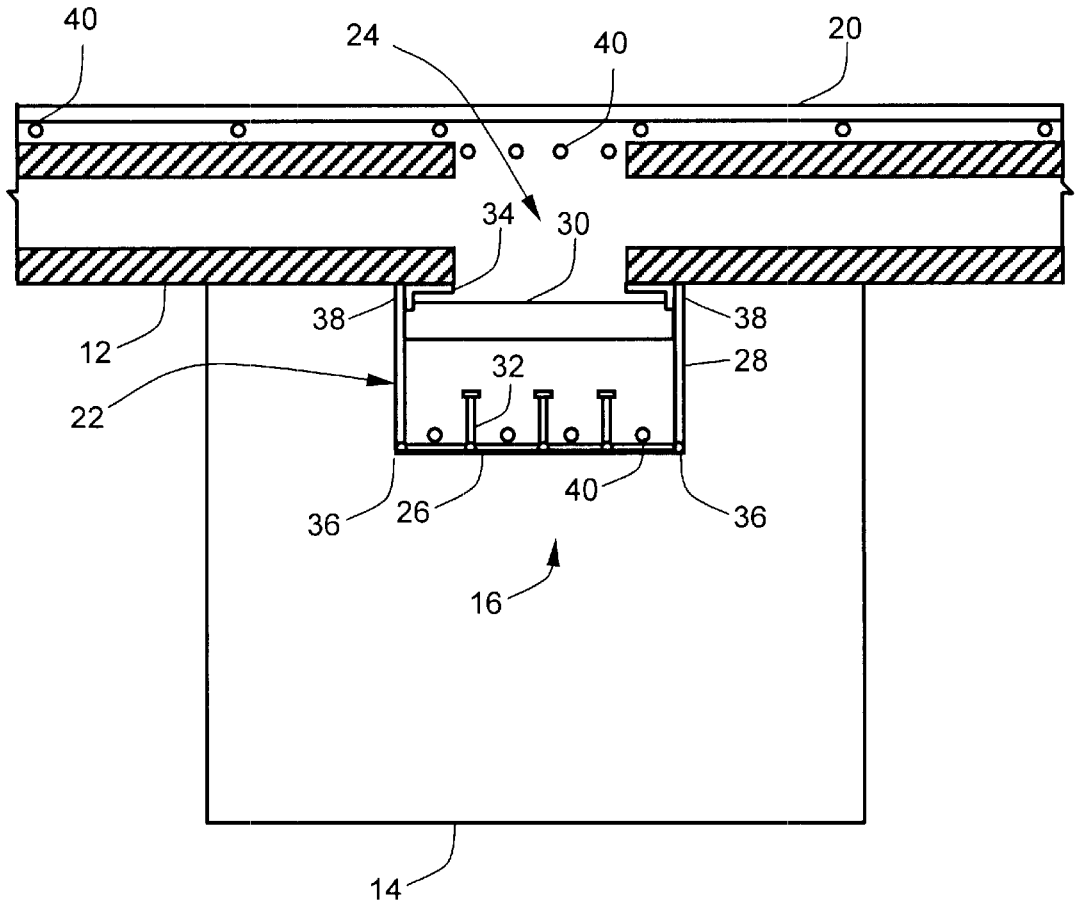
FIG. 2 is a cross-sectional view which illustrates a preferred embodiment of the composite beam.

FIG. 2 is a cross-sectional view of a preferred embodiment of a composite beam 16 supporting precast floor components 12. In this embodiment, composite beam 16 includes an exterior steel beam 22 sheath and solidifying material 24. In this embodiment, the steel beam 22 includes a bottom plate 26, containment sides 28, reinforcement means 30, joining means 32 and horizontal support surfaces 34. Containment sides 28 are attached to the bottom plate 36, by welding or other means, and extend upwardly. FIG. 2 illustrates the containment sides 28 attached along the outer edges 36 of the bottom plate, but may be attached inward away from the outer edges to form one or more lower support surfaces (not shown). Horizontal support members are attached to the containment sides 28 along they uppermost edge 38 to form a support surface 34, by welding or other means. These members may extend inwardly towards the center of the beam 22 or outwardly away from the beam. The horizontal support members provide a support surface 34 for the floor components 12. It will be understood that horizontal support members may be oriented on either face of the containment side 28 and at various elevations, the location being merely a decision choice. It is also contemplated that the support surface 34 provided by the support members may be formed by merely thickening the uppermost edge 38 to a suitable width.

In the illustrated embodiment, reinforcement means 30 are attached at one end to the inside face of a containment side 28 and at the opposite end to the inside face of a second containment side. Placed approximately four feet on-center, one purpose of the reinforcement means 30 is to restrain the containment sides 28 from lateral movement. By way of example and not limitation, the reinforcement means 30 illustrated are strap bars. It will be understood that equally suitable reinforcement means includes but is not limited to well known restraining/reinforcement devices such as but not limited to strap bars, interior or exterior mounted ribs, fins, stiffening plates, angles and bands. Various reinforcement means may be positioned at differing locations. In the illustrated embodiment, joining means 32 are attached to the bottom plate approximately one foot on-center, one purpose of the joining means 32 is to anchor the cured concrete to the steel beam 22. By way of example and not limitation, the joining means 32 illustrated are studs. It will be understood that equally suitable joining means includes but is not limited to well known shear/joining devices such as but not limited to studs, ribs, fins, anchor bolts and rebar. Various joining means may be positioned at differing locations. Further, an abundance of reinforcement means may serve the combined function of reinforcing devices and joining devices.

In the illustrated embodiment, the bottom plate 26, containment sides 28, reinforcement means 30, joining means 32, and horizontal support surfaces 34 are formed from forged or standard rolled shape steel. Nevertheless, it is contemplated that as a design choice, steel may be substituted with other materials that meet minimum performance characteristics. It is also contemplated that the individual elements of the steel beam 22 enumerated above may be formed as a single, substantially monolithic unit.

The steel beam 22 supports the bottom surface of the floor component 12 with the horizontal support surfaces 34. Reinforcing members 40 may be added to provide additional force bearing capacity to the composite beam 16, and are located according to design criteria. Reinforcing members 40 may be well known reinforcing members such as rebar or post tensioned cables.

In erecting the framing system 10, the foundation (not shown) and vertical columns 14 are constructed according to the methods well known by those skilled in the art. In the illustrated embodiment, the columns are concrete, either precast or poured in place and are provided with a receiving saddle 44, best shown in FIG. 4. The saddles 44, which are approximately the height of the composite beam 16 approximately 1" wider and approximately 3" deep, receive and support the end of the composite beam 16. The end of each composite beam 16 maybe further secured to the column by methods well known to those skilled in the art. It is contemplated that a plurality of columns 14 are erected which receive and support steel beams 22. Any temporary intermediate supports required may now be installed. The steel beams 22 then receive and support flooring components 12, such as precast concrete planks or metal decking, along the horizontal supports 34.

FIG. 2 best illustrates flooring components 12, supported by a steel beam 22, which in turn is supported by columns 14. Next, in the process of erecting the framing system 10 a solidifying material 24, such as but not limited to concrete, is poured into the steel beam 22 where it fills the cavity created by the bottom plate 26 and sides 28. The reinforcement means 30 act to resist the outward forces created by the wet concrete and the joining means 32 act to anchor the cured concrete to the steel beam 22. Sufficient concrete 24 is poured to fill the steel beam 22, flow into the hollow cores of the precast floor planks 12, and rise to the upper surface of the planks. Alternatively, concrete 24 is poured to fill the steel beam 22 and added to fill a metal deck flooring component to create a finished subfloor. It is contemplated that concrete 24 can continue to be added to form the bonding layer 20 and to fill any voids in or around the columns 14. In other words, the solidifying material 24 and bonding layer 20 may be of the same plasticized material. The bonding layer 20 creates a substantially monolithic layer which connects and unites each horizontal level of flooring components 12, composite beams 16 and columns 14 together to form a rigid joint. By way of illustration and not limitation, the solidifying mixture 24 illustrated is poured concrete. It will be understood that equally suitable solidifying means include but are not limited to well known plastic bonding materials that solidify to realize increased performance characteristics such as cement, grout, Gypcreteo®, and similar performance enhanced concretes.

During erection of the framing system 10, the steel beam 22 initially provides temporary support to the floor components 12. Thereafter, the steel beam 22 acts as a form to accept the concrete 24. Finally, the steel beam 22 becomes an integral part of the composite beam 16. Some of the advantages realized by providing the steel beam 22 include:

the virtual elimination of temporary shoring, the virtual elimination of temporary forms, and isolating concrete pouring to a single critical step per horizontal level. Some of the advantages realized by providing the composite beam 16 include a structural beam with greatly improved performance characteristics in spans of at least sixty feet in length, and a substantially more rigid frame 10 by interlocking the flooring components 12, composite beams 16 and columns 14 of each horizontal level together with a bonding layer 20. Individually and together these advantages reduce construction related expenses and time.

Figure 3:
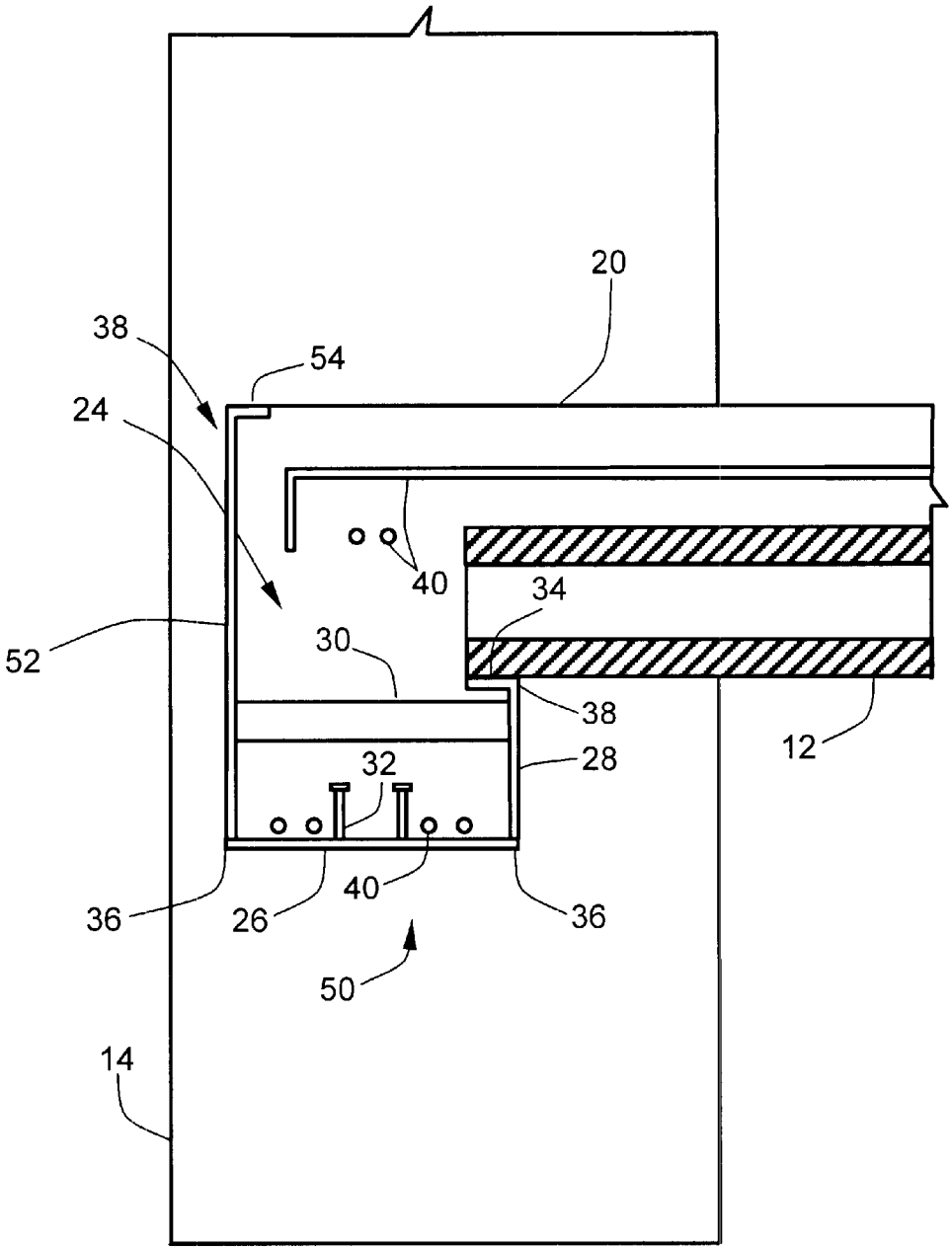
FIG. 3 is a cross-sectional view of a preferred composite beam supporting the perimeter of a flooring system.

FIG. 3 depicts a preferred embodiment of a perimeter composite beam 50 adapted for use along the perimeter of a horizontal level. The composite beam 50 includes an exterior containment side 52 that extends upwardly from the bottom plate 26. In the illustrated embodiment, the upper edge 38 terminates and returns at the elevation of the bonding layer 20. It will be understood that the configuration, even the existence, of the return position 54 is a design choice and may be replaced with a horizontal support 34 for the purpose of attaching walls, windows, rails or other building components. The remaining components illustrated in FIG. 3, together with their advantages, are substantially identical to the steel beam 22 and composite beam 16 described above.

Figure 4:
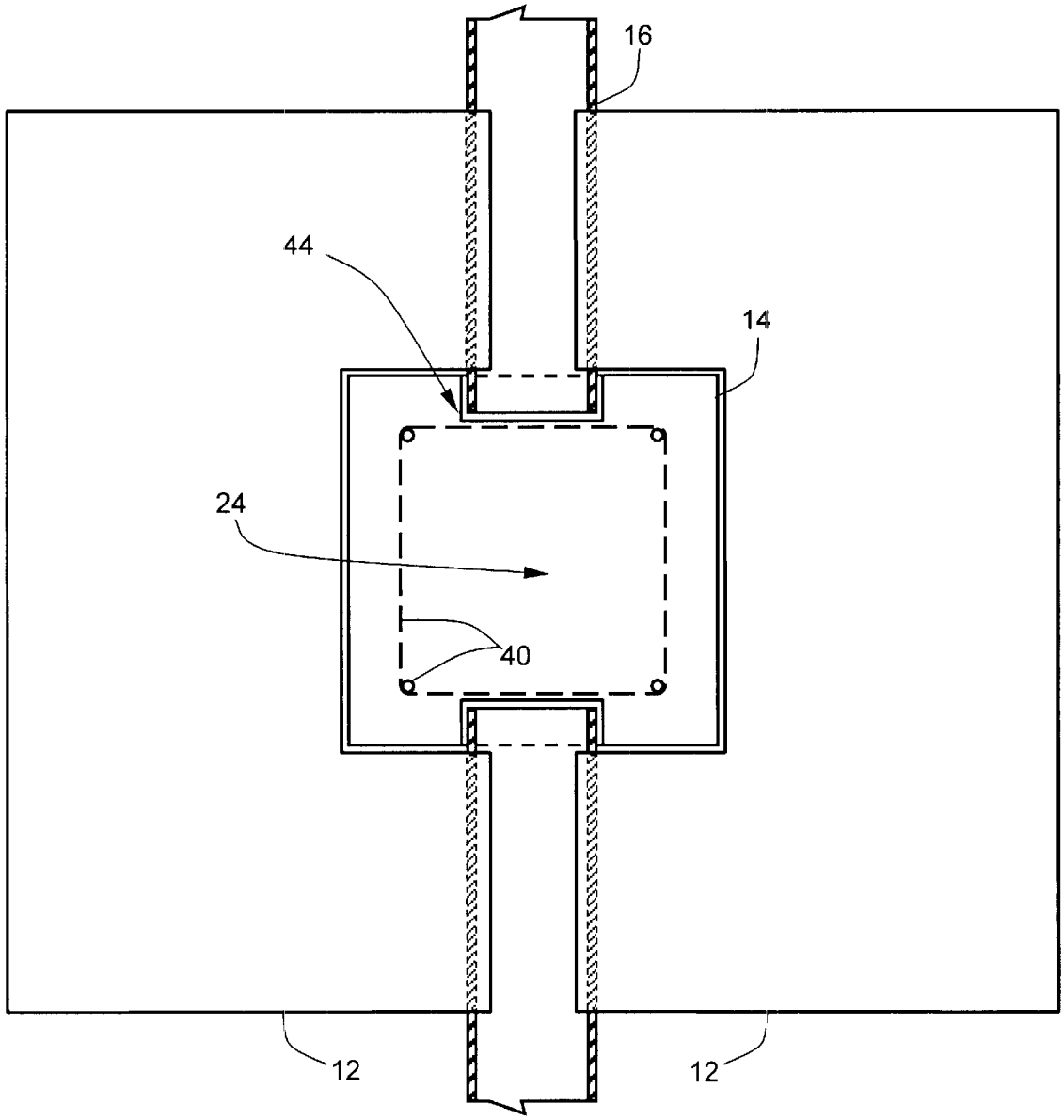
FIG. 4 is a cross-sectional view of a column and two preferred beams illustrating a preferred connection between a column and beam.

FIG. 4 illustrates a cross-section of a typical concrete column 14 supporting one end each of two steel beams 22. Flooring components 12 are also shown supported by the steel beams 22. The vertical column 14 illustrated is a poured in place concrete column, constructed in a manner well known by those skilled in the art. It is also contemplated that the column 14 may be configured with precast concrete or a steel beam. The support column 14 illustrated includes two receiving saddles 44 to support the steel beams 22. The location and number of receiving saddles 44 is a design choice, as is any additional attachment means between the beam 22 and column 14.

From the configuration of the horizontal level illustrated in FIG. 4, the next step in constructing the framing system is to pour solidifying material 24 into the steel beam 22 and pour the bonding layer 20. The selection of solidifying material 24 and bonding layer 20 is a design choice governed by structural design criteria and construction timing requirements. It will be understood that some blocking (not shown) may be necessary around the columns 14 to stop seepage of the material 24 or bonding layer 20 and that few temporary intermediate supports will be required to support the steel beam 22 while the concrete is wet, but the need for intermediate supports is ultimately a design choice.

While various embodiments of this invention have been described above, these descriptions are given for purposes of illustration and explanation. Variations, changes, modifications, and departures from the systems and methods disclosed above may be adopted without departure from the spirit and scope of this invention.

What is claimed is:

1. A composite framing system, comprising:

a plurality of columnar members vertically erected;

a composite structural member supported between adjacent columnar members, the composite structural member comprising;

an exterior sheathing, comprising:

a bottom plate;

a plurality of containment sides extending upwardly from said bottom plate, wherein at least one of said containment sides includes at least one integral support surface; and an interior cavity configured to receive a solidifying mixture; at least one floor section, comprising:

a top surface;

a bottom surface opposite said top surface and supported by said integral support surface; and an interior void between said top surface and said bottom surface, where said interior void is contiguous to said interior cavity of said exterior sheathing, and is configured to receive the solidifying mixture thereby connecting and uniting said floor section to said exterior sheathing; and a bonding layer which connects and unites said columnar members, floor section, and composite beam to form a rigid joint.

2. The framing system of claim 1, wherein each of said columnar members includes a saddle to receive and support said structural member.

3. The framing system of claim 1, wherein said exterior sheathing further comprises at least one reinforcing means attached to at least one of said containment sides, and at least one joining means attached to said bottom plate.

4. The framing system of claim 3, wherein said reinforcement means is a plurality of reinforcement devices.

5. The framing system of claim 3, wherein said joining means is a plurality of joining devices.

6. The framing system of claim 1, wherein said solidifying material substantially fills said interior cavity and said interior void in said floor section.

7. The framing system of claim 1, wherein said bonding layer is a material substantially identical to said solidifying material that fills said interior cavity and said interior void, and wherein said bonding layer is contiguous to said solidifying material, is disposed upon said upper surface of said floor section, and captures said columnar members.

8. The framing system of claim 1, wherein said floor section is a precast hollow core plank and said interior void is the hollow core of said precast hollow core plank.

9. The framing system of claim 1, wherein said solidifying material is poured concrete.

10. A method of erecting a substantially monolithic framing system, comprising:

erecting a plurality of columnar members;

supportively connecting one end of a beam to one of said columnar members, said beam defining: a bottom plate, a plurality of containment sides attached to said bottom plate, at least one support surface integral to at least one of said containment sides, an interior cavity configured to receive a solidifying mixture;

supportively connecting an opposite end of said beam to another of said columnar members;

spanning at least one floor section between a plurality of said floor section defining a top surface, a bottom surface opposite said top surface and supported by said integral support surface, and an interior void between said top surface and said bottom surface, where said interior void is contiguous to said interior cavity of said beam;

pouring solidifying material to substantially fill said interior cavity and to at least partially fill said interior void of said floor section;

disposing a bonding layer over said solidifying material, over said floor section and around said columns to unite and form a rigid joint.

11. The method of claim 10, wherein said floor sections are precast floor planks with hollow cores.

12. The method of claim 10, wherein said solidifying material is poured concrete.

* * * * *